US009908020B1

(12) United States Patent
Simmons, II et al.

(10) Patent No.: US 9,908,020 B1
(45) Date of Patent: Mar. 6, 2018

(54) GOLF PRACTICE SYSTEM

(71) Applicants: David R. Simmons, II, Tampa, FL (US); Richard Porter, Tampa, FL (US)

(72) Inventors: David R. Simmons, II, Tampa, FL (US); Richard Porter, Tampa, FL (US)

( * ) Notice: Subject to any disclaimer, the term of this patent is extended or adjusted under 35 U.S.C. 154(b) by 0 days.

(21) Appl. No.: 15/470,460

(22) Filed: Mar. 27, 2017

Related U.S. Application Data

(60) Provisional application No. 62/314,218, filed on Mar. 28, 2016.

(51) Int. Cl.

| | |
|---|---|
| ***A63B 55/00*** | (2015.01) |
| ***A63B 55/50*** | (2015.01) |
| ***A63B 69/36*** | (2006.01) |
| ***A63B 55/20*** | (2015.01) |

(52) U.S. Cl.
CPC ..... *A63B 55/50* (2015.10); *A63B 55/20* (2015.10); *A63B 69/36* (2013.01)

(58) Field of Classification Search
USPC ..... 473/282; 206/315.2, 315.3, 745
See application file for complete search history.

(56) References Cited

U.S. PATENT DOCUMENTS

| | | | | | |
|---|---|---|---|---|---|
| 2,791,255 | A * | 5/1957 | Ogden | A63B 55/10 | 206/315.2 |
| 2,905,480 | A * | 9/1959 | Giovannelli | B62B 3/10 | 280/47.19 |
| 2,918,297 | A * | 12/1959 | Peters | B62B 1/262 | 224/274 |
| 5,234,114 | A * | 8/1993 | Coffey | A63B 55/10 | 206/315.2 |
| 5,797,612 | A * | 8/1998 | Buccioni | B62B 1/12 | 280/47.19 |
| 5,833,250 | A * | 11/1998 | Schier | B62B 1/22 | 280/47.19 |
| 7,740,135 | B2 * | 6/2010 | Taylor | A63B 55/00 | 206/315.1 |
| 2002/0193184 | A1 * | 12/2002 | Currie | A63B 69/3614 | 473/409 |
| 2010/0051505 | A1 * | 3/2010 | Thomas | A47F 7/0021 | 206/745 |

* cited by examiner

*Primary Examiner* — Nini Legesse

(57) ABSTRACT

A tray is formed of a base in a horizontal plane with a periphery in a rectangular configuration. The tray has four side walls extending upwardly from the periphery of the base. The tray has divider panels dividing the tray into chambers. An outwardly extending plank has a sinusoidal exterior with indents for removably receiving and supporting upper extents of golf clubs. A stand has three pivoting legs below and a pivot assembly above with a horizontal dovetail slot. A dovetail projection depending downwardly from the base of the tray is slidably received in the dovetail slot.

4 Claims, 4 Drawing Sheets

FIG. 3
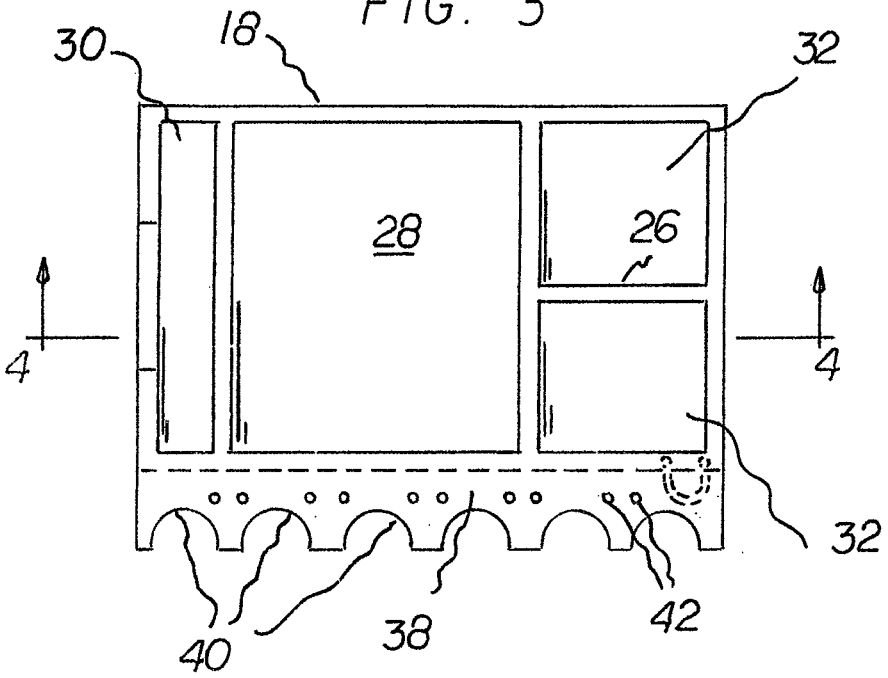
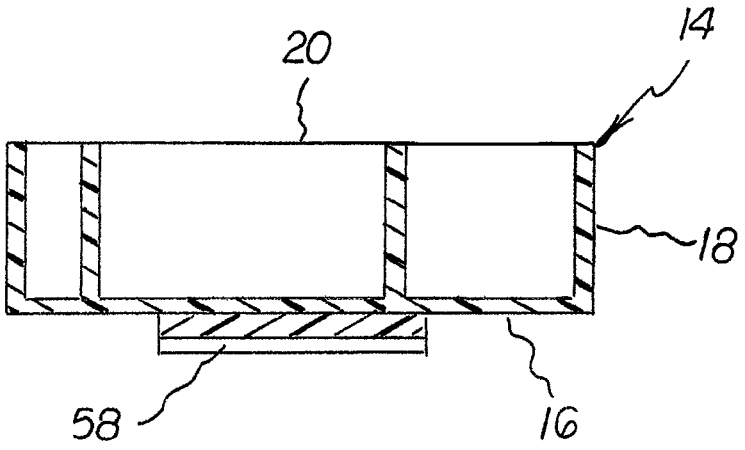
FIG. 4

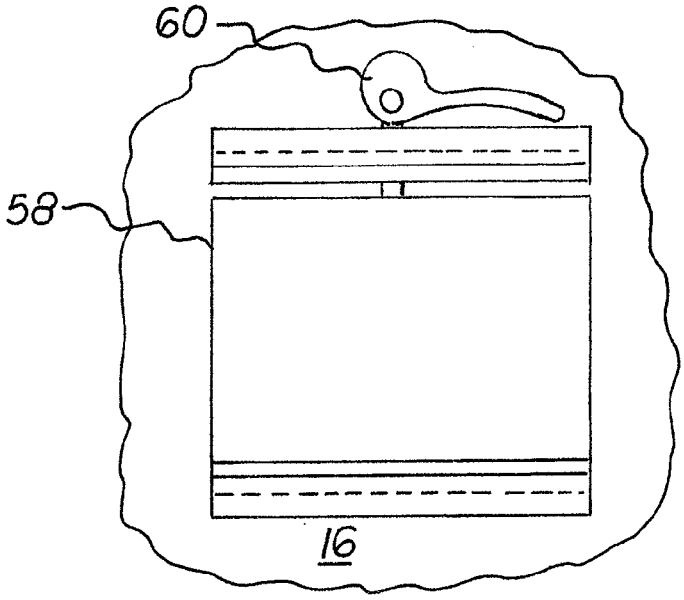
FIG. 6
FIG. 7
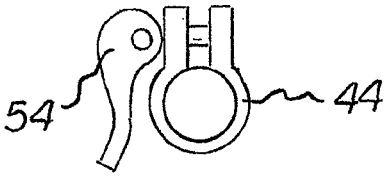
FIG. 8
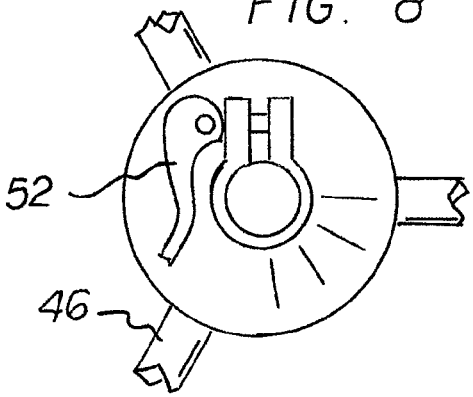
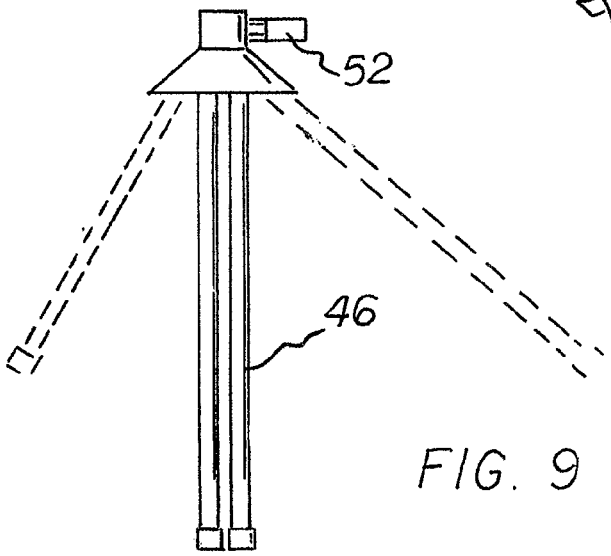
FIG. 9

GOLF PRACTICE SYSTEM

BACKGROUND OF THE INVENTION

Field of the Invention

The present invention relates to a golf practice system and more particularly pertains to supporting golf clubs and golf related items at a practice range and for maximizing practice time due to organization of equipment.

Description of the Prior Art

The use of golfing aids is known in the prior art. More specifically, golfing aids previously devised and utilized for the purpose of training golfers are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a golf practice system that allows supporting golf clubs and golf related items at a practice range and for maximizing practice time due to organization of equipment.

In this respect, the golf practice system according to the present invention substantially departs from the conventional concepts and designs of the prior art, and in doing so provides an apparatus primarily developed for the purpose of supporting golf clubs and golf related items at a practice range and for maximizing practice time due to organization of equipment.

Therefore, it can be appreciated that there exists a continuing need for a new and improved golf practice system which can be used for supporting golf clubs and golf related items at practice range and for maximizing practice time due to organization of equipment. In this regard, the present invention substantially fulfills this need.

SUMMARY OF THE INVENTION

In view of the disadvantages inherent in the known types of golfing aids now present in the prior art, the present invention provides an improved golf practice system. As such, the general purpose of the present invention, which will be described subsequently in greater detail, is to provide a new and improved golf practice system and method which has all the advantages of the prior art and none of the disadvantages.

To attain this, from a broad perspective, the present invention essentially comprises a tray formed of a base in a horizontal plane with a periphery in a rectangular configuration. The tray has four side walls extending upwardly from the periphery of the base. The tray has divider panels dividing the tray into chambers. An outwardly extending plank has a sinusoidal exterior with indents for removably receiving and supporting upper extents of golf clubs. A stand has three pivoting legs below and a pivot assembly above with a horizontal dovetail slot. A dovetail projection depending downwardly from the base of the tray is slidably received in the dovetail slot.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf practice system which has all of the advantages of the prior art golfing aids and none of the disadvantages.

It is another object of the present invention to provide a new and improved golf practice system which may be easily and efficiently manufactured and marketed.

It is a further object of the present invention to provide a new and improved golf practice system which is of durable and reliable constructions.

An even further object of the present invention is to provide a new and improved golf practice system which is susceptible of a low cost of manufacture with regard to both materials and labor, and which accordingly is then susceptible of low prices of sale to the consuming public, thereby making such golf practice system economically available to the buying public.

Lastly, it is an object of the present invention to provide a golf practice system for supporting golf clubs and golf related items at a practice range and for maximizing practice time due to organization of equipment.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view taken along line 3-3 of FIG. 2

FIG. 4 is a cross sectional view taken along line 4-4 of FIG. 3.

FIG. 6 is a cross sectional view taken along line 6-6 of FIG. 5.

FIG. 7 is a cross sectional view taken along line 7-7 of FIG. 5.

FIG. 8 is a cross sectional view taken along line 8-8 of FIG. 5.

FIG. 9 is a front elevational view of the lower component with the legs in open and closed positions.

The same reference numerals refer to the same parts throughout the various Figures.

DESCRIPTION OF THE PREFERRED EMBODIMENT

Figure 1:
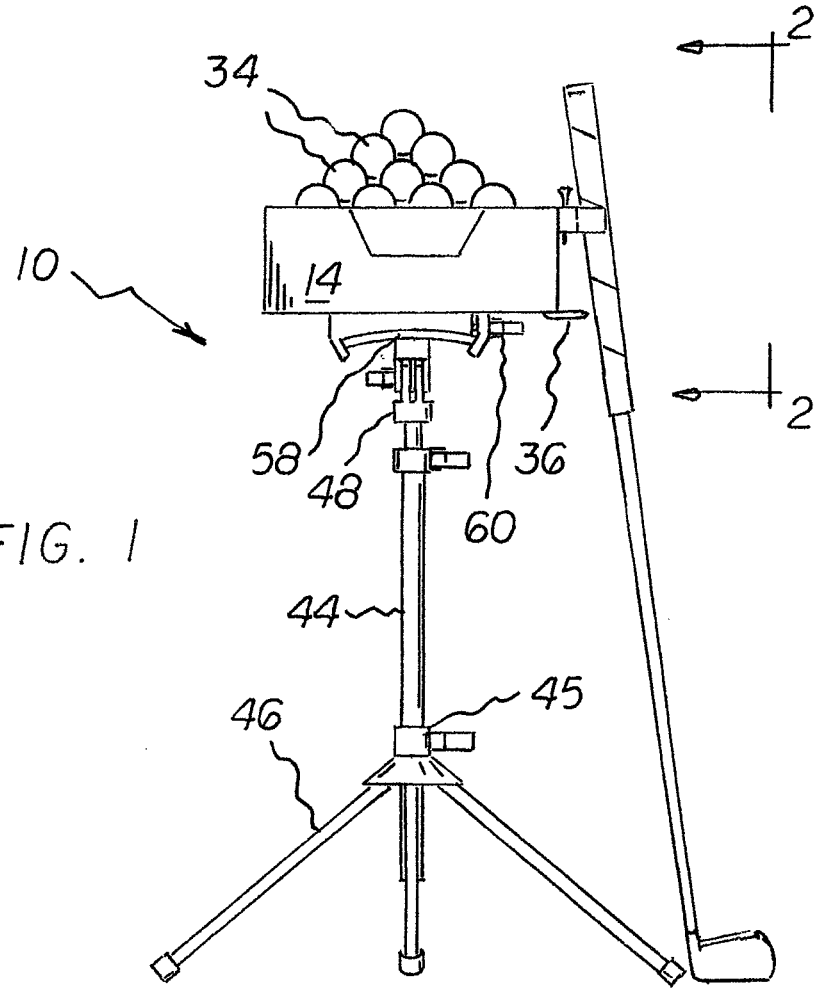
FIG. 1 is a side elevational view of a golf practice system constructed in accordance with the principles of the present invention.
Figure 2:
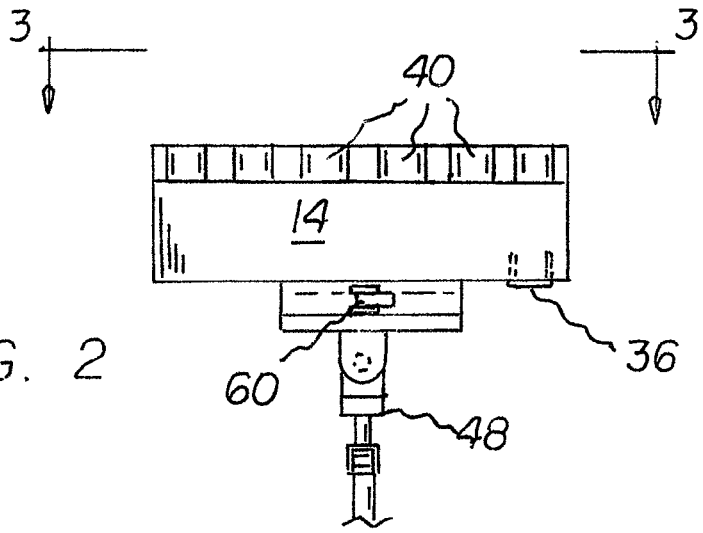
FIG. 2 is a front elevational view taken along line 2-2 of FIG. 1.
Figure 5:
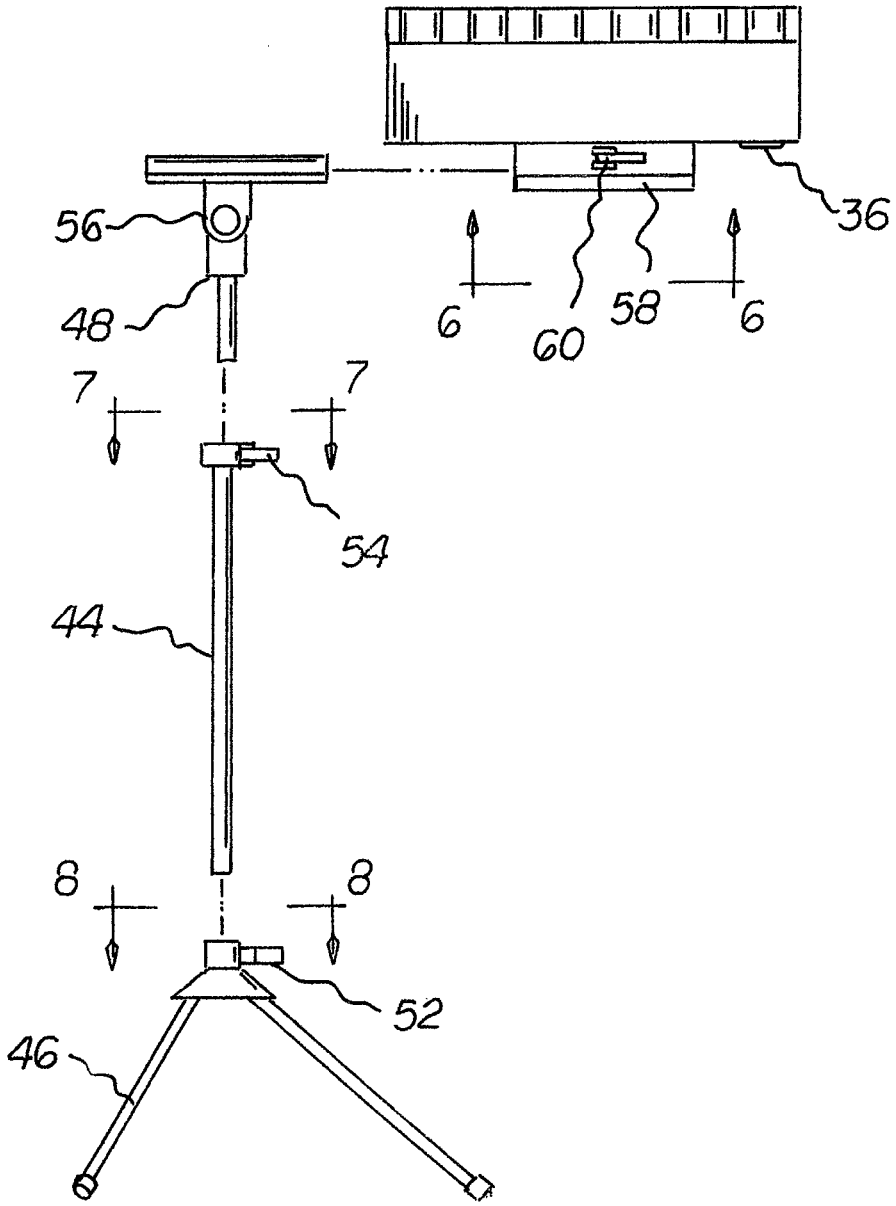
FIG. 5 is an exploded side elevational view of the system shown in the prior Figures.

With reference now to the drawings, and in particular to FIG. 1 thereof, the preferred embodiment of the new and improved golf practice system embodying the principles and concepts of the present invention and generally designated by the reference numeral 10 will be described.

The present invention, the golf practice system 10 is comprised of a plurality of components. Such components in their broadest context include a tray with divider panels and a stand with three foldable legs. Such components are individually configured and correlated with respect to each other so as to attain the desired objective.

From a specific perspective, the invention of the present application is a golf practice system 10 for supporting golf clubs and golf related items at a practice range and for maximizing practice time due to organization of equipment. The supporting and the maximizing is done in a safe, convenient, and economical manner. The system includes a tray 14 formed of a base 16 in a horizontal plane with a periphery in a rectangular configuration. The tray has four side walls 18 extending upwardly from the periphery of the base. The tray has an open top 20. Two longitudinal divider panels 22, 24 and one latitudinal divider panel 26 divide the tray into a large square central chamber 28, one rectangular side rectangular chamber 30, and two small square side chambers 32. The chambers are adapted to receive and support golf related objects including a plurality of golf balls 34 in the central chamber.

A plurality of supports are coupled to the tray exterior of the chambers. The supports include a downwardly extending hook 36 for a towel. The supports also include an outwardly extending plank 38 with vertical holes 42 for supporting tees. The plank has a sinusoidal exterior with indents 40 for receiving the upper extents of golf clubs.

A stand comprises a lower component 45, a middle component 44, and an upper component 48. The lower component has a lower end with three pivoting legs 46 and also has an upper end with a lower cylindrical recess. The middle component 44 has a lower end removably received in the lower cylindrical recess and also has an upper cylindrical recess. The upper component 48 has a lower end removably received in the upper cylindrical recess of the middle component and also has an upper end with a pivot assembly and a horizontal dovetail slot.

Lastly, a first clamp 52 with a handle secures the lower component and the middle component. A second clamp 54 with a handle secures the middle component to the upper component. A third clamp 56 with a handle secures the tray in an angular orientation with respect to horizontal. A dovetail projection 58 depending downwardly from the base of the tray is slidably received in the dovetail slot. A fourth clamp 60 secures the tray to the stand.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf practice system comprising a tray formed of a base in a horizontal plane with a periphery in a rectangular configuration, the tray having four side walls extending upwardly from the periphery of the base, the tray having divider panels dividing the tray into chambers;

an outwardly extending plank having a sinusoidal exterior with indents for removably receiving and supporting upper extents of golf clubs; and a stand having three pivoting legs below and having a pivot assembly above with a horizontal dovetail slot; and a dovetail projection depending downwardly from the base of the tray slidably received in the dovetail slot.

2. The system as set forth in claim 1 wherein the stand includes a lower component and a middle component and an upper component, the lower component having a lower end with three pivoting legs and having an upper end with a lower cylindrical recess, the middle component having a lower end removably received in the lower cylindrical recess and having an upper cylindrical recess, the upper component having a lower end removably received in the upper cylindrical recess and having an upper end with a pivot assembly and a horizontal dovetail slot.

3. The system as set forth in claim 2 wherein:

the divider panels include two longitudinal divider panels and one latitudinal divider panel; and the chambers include a large square central chamber and one side rectangular chamber and two small square side chambers.

4. A golf practice system (10) for supporting golf clubs and golf related items at a practice range and for maximizing practice time due to organization of equipment, the supporting and the maximizing being done in a safe, convenient, and economical manner, the system comprising, in combination:

a tray (14) formed of a base (16) in a horizontal plane with a periphery in a rectangular configuration, the tray having four side walls (18) extending upwardly from the periphery of the base, the tray having an open top (20), two longitudinal divider panels (22)(24) and one latitudinal divider panel (26) dividing the tray into chambers, the chambers including a large square central chamber (28) and one rectangular side rectangular chamber (30) and two small square side chambers (32), the chambers adapted to receive and support golf related objects including a plurality of golf balls (34) in the central chamber;

a plurality of supports coupled to the tray exterior of the chambers, the supports including a downwardly extending hook (36) for a towel, the Supports also including an outwardly extending plank (38) with vertical holes (42) for supporting tees, the plank having a sinusoidal exterior with indents (40) for receiving upper extents of golf clubs;

a stand comprising a lower component (45) and a middle component (44) and an upper component (48), the lower component having a lower end with three pivoting legs (46) and having an upper end with a lower cylindrical recess, the middle component (44) having a lower end removably received in the lower cylindrical recess and having an upper cylindrical recess, the upper component (48) having a lower end removably received in the upper cylindrical recess and having an upper end with a pivot assembly and a horizontal dovetail slot; and a first clamp (52) with a handle for securing the lower component and the middle component, a second clamp (54) with a handle securing the middle component to the upper component, a third clamp (56) with a handle securing the tray in an angular orientation with respect to horizontal, a dovetail projection (58) depending downwardly from the base of the tray slidably received in the dovetail slot, and a fourth clamp (60) to secure the tray to the stand.

* * * * *